US006003845A

United States Patent [19]

Kus

[11] Patent Number: 6,003,845

[45] Date of Patent: Dec. 21, 1999

[54] FUEL MIXTURE ADJUSTING AND LIMITING DEVICE

[75] Inventor: Dale P. Kus, Cass City, Mich.

[73] Assignee: Walbro Corporation, Cass City, Mich.

[21] Appl. No.: 09/046,909

[22] Filed: Mar. 24, 1998

[51] Int. Cl.[6] ..... F02M 3/10

[52] U.S. Cl. ..... 261/39.4; 137/382; 251/227; 261/71; 261/DIG. 38; 261/DIG. 84

[58] Field of Search ..... 261/71, 39.4, DIG. 23, 261/DIG. 24, DIG. 38, DIG. 39, DIG. 84; 251/227, 291; 137/382, 382.5

[56] References Cited

U.S. PATENT DOCUMENTS

| | | | |
|---|---|---|---|
| 3,696,997 | 10/1972 | Gifford | 261/71 |
| 3,896,194 | 7/1975 | Martin | 261/DIG. 38 |
| 4,154,782 | 5/1979 | Sherwin et al. | 261/71 X |
| 4,271,095 | 6/1981 | Maeda | 137/382 X |
| 4,277,423 | 7/1981 | Noguez | 261/71 X |
| 4,465,643 | 8/1984 | Isoya | 261/DIG. 38 |
| 4,568,499 | 2/1986 | Wood | 251/227 X |
| 4,853,160 | 8/1989 | Wood | 261/71 X |
| 5,322,645 | 6/1994 | Hammett et al. | 261/DIG. 84 |
| 5,667,734 | 9/1997 | Ohgane | 261/DIG. 84 |
| 5,707,561 | 1/1998 | Swanson | 137/382 X |
| 5,753,148 | 5/1998 | King et al. | 261/DIG. 38 |
| 5,772,927 | 6/1998 | Koizumi et al. | 261/71 X |

FOREIGN PATENT DOCUMENTS

| | | | |
|---|---|---|---|
| 1322570 | 7/1973 | United Kingdom | 261/71 |

*Primary Examiner*—Richard L. Chiesa
*Attorney, Agent, or Firm*—Reising, Ethington, Barnes, Kisselle, Learman & McCulloch, P.C.

[57] ABSTRACT

A fuel mixture adjusting and limiting device for a carburetor has a body received in a bore of the carburetor and defining a fuel passage through which liquid fuel is supplied to the high and/or low speed system of the carburetor, an inlet opening in the body through which fuel enters the fuel passage from a metering chamber of the carburetor and a metering pin slidably carried by the body and capable of at least partially restricting the flow of fuel through the inlet opening to control the flow rate of fuel through the body. An adjustment screw threadably received in the bore of the carburetor is rotatable to axially displace the adjustment screw and during at least a portion of the axial range of movement of the adjustment screw, the adjustment screw bears on the metering pin to axially displace the metering pin and thereby control the flow area of the inlet opening. Preferably, the adjustment screw carries an adjustment pin which is axially displaceable relative to the adjustment screw and constructed to engage the metering pin to displace it. The axial location of the adjustment pin relative to the adjustment screw can be varied to alter the relationship between the adjustment screw and the metering pin.

28 Claims, 2 Drawing Sheets

FUEL MIXTURE ADJUSTING AND LIMITING DEVICE

FIELD OF THE INVENTION

This invention relates generally to carburetors and more particularly to a fuel mixture adjusting and limiting device for a carburetor.

BACKGROUND OF THE INVENTION

Carburetors are widely used to produce and control the mixture of fuel and air delivered to an operating engine. Current carburetors utilize a needle valve assembly to meter the quantity of fuel in the fuel and air mixture. The needle valve assembly comprises a pin or needle threadably received in a bore of the carburetor and rotatable to vary the location of a conical end of the needle relative to a machined annular seat to control the flow area between the needle and the seat and thereby control the amount of fuel which flows therethrough. One of the major problems with needle valve assemblies is that a fuel flow change can and usually does occur after the needle valve assembly has been adjusted. This fuel flow change is caused by axial and radial movement after adjustment of the conical tip of the needle relative to the seat which may be caused by vibration, temperature changes, installation of limiting caps and other physical side loading of the needle. Radial movement of the needle relative to the valve seat decreases the gap between the needle and the valve seat adjacent one portion of the needle and increases the gap on the opposite portion of the needle which can drastically affect the fuel flow characteristics therethrough.

Another problem with the needle valve assemblies is the size of the metering orifice. The annular fuel flow area between the needle and the valve seat is generally on the order of about 0.001 inches to 0.002 inches wide. Most particles such as dirt or aluminum flakes within the carburetor are too large to pass through this gap and may at least partially clog the fuel flow area causing the engine to run leaner than desired.

Additionally, the construction and arrangement of a needle valve assembly is determined by the calibration requirements of each individual engine family. Therefore, the needle valve assemblies are generally not interchangeable among the various engine families resulting in the need for hundreds of different mixture needle valve assemblies to accommodate the various carburetor models and engine designs. Still further, variances in the production of the needle and the valve seat result in an inconsistent relationship between the needle and the valve seat which causes carburetors with the same calibration requirements to have inconsistent fuel flow rates.

Also, to limit the extent to which the end user could vary the fuel flow rate through a needle valve assembly a limiter cap or the like has to be installed on the needle to limit the extent to which it can be rotated. These limiter caps increase the cost to manufacture and assemble the needle valve assemblies and may cause the needle valve to shift relative to its seat as the caps are installed and thereby, after adjustment, alter the fuel flow rate of the valve assembly.

SUMMARY OF THE INVENTION

A fuel mixture adjusting and limiting device for a carburetor has a body received in a bore of the carburetor and defining a fuel passage through which liquid fuel is supplied to the high and/or low speed system of the carburetor, an inlet opening in the body through which fuel enters the fuel passage from a chamber of the carburetor and a metering pin slidably carried by the body and capable of at least partially restricting the flow of fuel through the inlet opening to control the flow rate of fuel through the fuel passage in the body. An adjustment screw threadably received in the bore of the carburetor is rotatable to axially move the metering pin during at least a portion of the axial range of movement of the adjustment screw and thereby control the flow area of the inlet opening. Preferably, the adjustment screw carries an adjustment pin which is axially displaceable relative to the adjustment screw and constructed to engage the metering pin to displace it. The axial location of the adjustment pin relative to the adjustment screw can be varied to alter the relationship between the adjustment screw and the metering pin.

The fuel mixture adjusting and limiting device can be easily set to provide maximum and minimum fuel flow rates which cannot be exceeded by rotation of the adjustment screw. For instance, one way to provide a minimum fuel flow rate which cannot be diminished by rotation of the adjustment screw is to construct the device such that when the metering pin is in its filly extended position, the inlet opening is not completely restricted or closed off by the metering pin and the open portion of the inlet opening is sufficient to provide the minimum required fuel flow. Another way to achieve the minimum required fuel flow is to permit the metering pin in its fully extended position to close off the inlet opening and to provide a secondary inlet opening, not closed by the metering pin, of a size calibrated to provide the minimum required fuel flow therethrough.

The maximum fuel flow rate through the fuel passage can be calibrated by sizing the inlet opening, when fully open or completely unrestricted, to provide the maximum desired fuel flow rate. Another way to set the maximum fuel flow rate is to construct the device such that the metering pin, even in its fully retracted position, still at least partially restricts or closes the inlet opening with the open flow area of the inlet opening of a size sufficient to provide the maximum required fuel flow rate.

Thus, the minimum and maximum fuel flow rates can be set by the manufacturer to the desired levels and cannot be circumvented by the end user through rotation of the adjustment screw. Further, the axial displacement of the metering pin relative to the body has a far more consistent fuel flow rate therethrough than prior needle valve assemblies which were drastically affected by side loading or other movement of the needle. Also, even when set to provide the minimum fuel flow rate, the inlet area is generally large enough to permit small contaminants in the fuel to pass through the opening to prevent the opening from being clogged and thereby reducing the fuel flow rate through the fuel passage. Still further, the fine tuning possible with the adjustment pin movable relative to the adjustment screw permits a common construction of the fuel mixture adjusting and limiting device to be calibrated to meet the fuel flow requirements of a plurality of individual engine families and carburetor designs. Finally, the minimum and maximum fuel flow rates can be controlled without having to provide a separate limiter cap or some such other device to limit the rotation of the adjustment screw as was needed with needle valve assemblies and previous carburetor valve designs. Instead, in the present invention, the adjustment screw may be provided with an integral lobe which limits the rotation of the adjustment screw.

Objects, features and advantages of this invention include providing a fuel mixture adjusting and limiting device which facilitates limiting the minimum and maximum fuel flow rates through the device, prevents an end user from exceeding the fuel flow rate limitations, provides a consistent fuel flow rate throughout the life of the carburetor and is not subject to significant fuel flow rate changes due to vibration, or physical side loading of the device, provides a gap large enough to permit small contaminant particles to pass through the device without clogging the device even when set to provide the minimum fuel flow rate, can provide a fuel flow rate responsive to temperature changes, is readily adaptable to a wide variety of engine families and carburetor designs, is of relatively simple design and economical manufacture and assembly and has a long useful life in service.

BRIEF DESCRIPTION OF THE DRAWINGS

These and other objects, features and advantages of this invention will be apparent from the following detailed description of the preferred embodiments and best mode, appended claims and accompanying drawings in which:

DETAILED DESCRIPTION OF THE PREFERRED EMBODIMENTS

Figure 1:
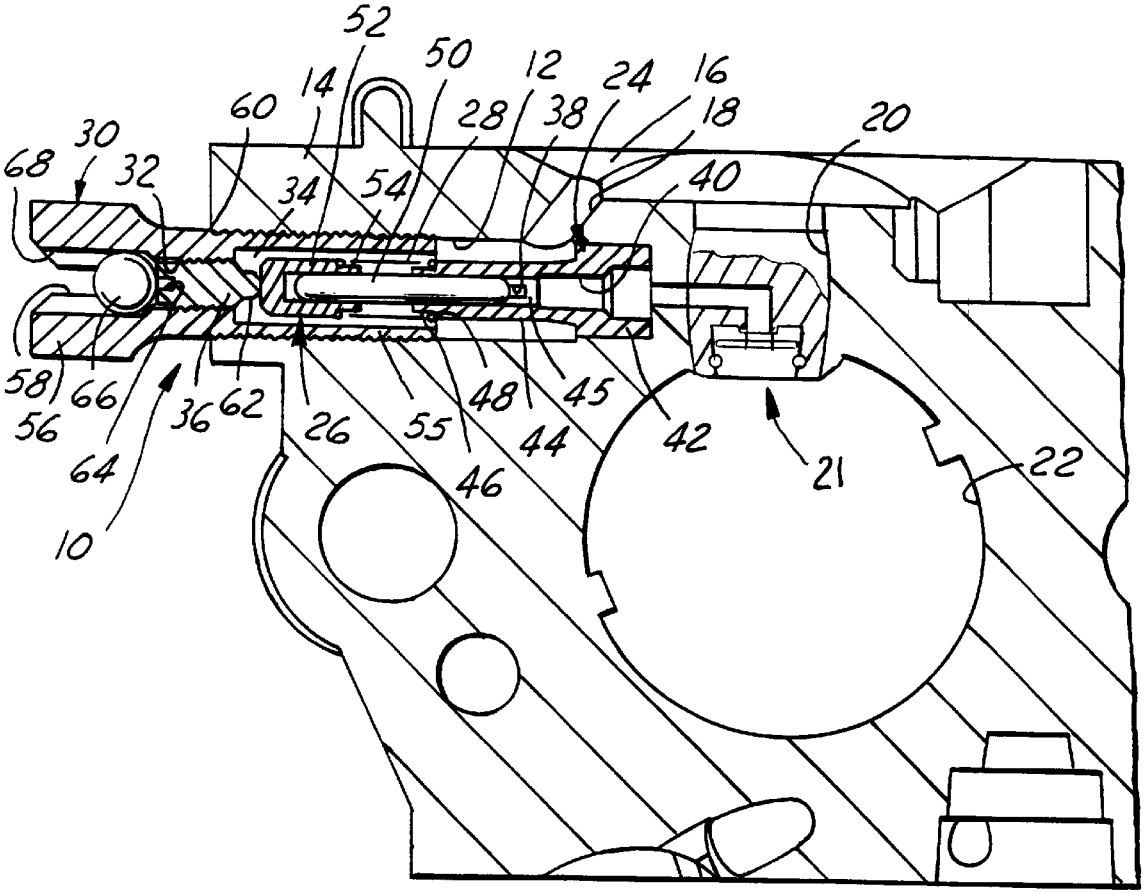
FIG. 1 is a cross-sectional view of a carburetor body with a fuel mixture adjusting and limiting device embodying the invention and received in a bore of the carburetor body.

Referring in more detail to the drawings, FIG. 1 illustrates a fuel mixture adjusting and limiting device 10 embodying the present invention and received in a bore 12 of a carburetor body 14 to meter and provide limitations on the flow rate of fuel delivered from the carburetor. The carburetor body 14 has a flexible diaphragm (not shown) which controls the pressure of fuel in a fuel metering chamber 16. The fuel metering chamber 16 communicates with the bore 12 through a passage 18 and the fuel mixture adjusting and limiting device 10 controls the rate of fuel flow to a main nozzle bore 20 in the body 10. The main nozzle bore 20 contains a main nozzle 21 through which fuel is drawn into an open bore venturi passage 22 to be mixed with the air flowing therethrough with the resulting fuel and air mixture then being supplied to an operating engine.

The fuel mixture adjusting and limiting device 10 has a body 24 press fit in the bore 12, a metering pin 26 slidably received in the body 24 for reciprocation between fully retracted and fully extended positions, a spring 28 yieldably biasing the metering pin 26 towards its fully retracted position, an adjustment screw 30 threadably received in the bore 12 and having a through bore 32 and a counterbore 34 in which the metering pin 26, spring 28 and body 24 may extend, and an adjustment pin 36 received in the through bore 32 of the adjustment screw 30. In general, to vary the fuel flow through the device 10, the metering pin 26 is displaced relative to an inlet opening 38 of the body 24 to vary the fuel flow area of the inlet opening 38 and thereby control the flow rate of fuel through the device 10.

Figure 2:
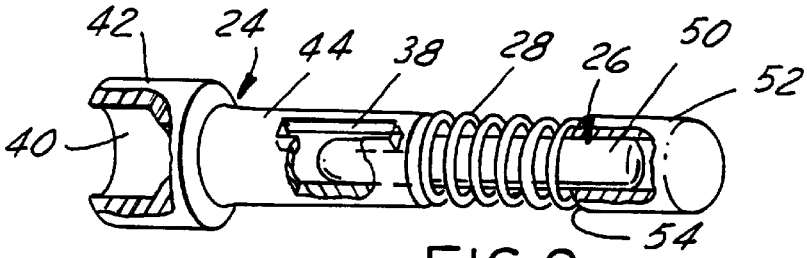
FIG. 2 is a perspective view with portions broken away of a body and a metering pin slidably received within the body according to the preferred embodiment of this invention.

The body 24 has a fuel passage 40 formed therethrough and in communication with the fuel metering chamber 16 through the passage 18, the bore 12 and the inlet opening 38 through the sidewall of the body 24. The body 24 has an enlarged base 42 which is preferably received with an interference fit in the bore 12 so that the body 24 remains stationary. The body 24 also has an axially elongate reduced diameter sleeve portion 44 with a through bore 45 open to slidably receive the metering pin 26. A recessed portion 46 adjacent the free end of the body 24 provides a shoulder 48 engaged by the spring 28. As shown in FIGS. 1 and 2, the inlet opening 38 is preferably axially elongate and generally rectangular. Alternatively, the inlet opening 38 may be of substantially any shape, such as oval, circular or a generally triangular inlet opening 38' as shown in FIGS. 4–7. Different inlet opening 38 configurations may be used to provide either a substantially constant or desired variable restriction to fuel flow through the inlet opening 38 per unit of displacement of the metering pin 26.

Figure 3:
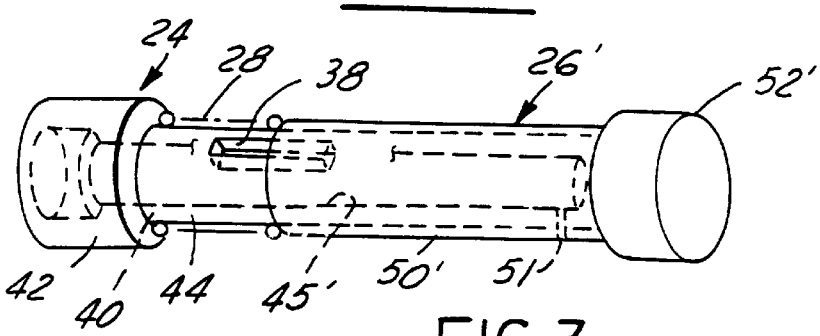
FIG. 3 is a perspective view of a body and a metering pin slidably received over a portion of the body.

The metering pin 26, as best shown in FIGS. 1–2, preferably has an elongate shank 50 and an enlarged head 52 providing a shoulder 54 constructed to engage the spring 28 biasing the metering pin 26. As shown, the shank 50 may be press fit into a separate head 52, or if desired the head and shank may be of integral construction. The shank 50 is constructed to be sidably received in the bore 45 of the body 24 with a close fit to minimize or prevent any leakage of fuel between the body 24 and the metering pin 26. When in its fully extended position, the metering pin 26 at least partially restricts the inlet opening 38 of the body 24 and in some embodiments, may fully restrict or fully close the inlet opening 38. When in its fully retracted position, the metering pin 26 preferably closes or restricts at least a portion of the inlet opening 38, although, in some embodiments, the metering pin 26 provides no restriction of the inlet opening 38 when in its fully retracted position. An alternate metering pin 26' construction, as shown in FIG. 3, comprises a cylindrical tubular sleeve 50' telescopically and slidably received over the reduced diameter portion of the body 24 for reciprocation between fully retracted and fully extended positions to vary the fuel flow through the inlet opening 38. Preferably, the fuel passage 40 is defined in a blind bore 45' formed in the body 24 to prevent fuel from flowing through the sleeve 50'. A vent hole 51 through the body 24 may be provided to limit any differential pressure across the body 24. The sleeve 50' may have an integral or attached head 52' for engagement with the adjustment pin 36.

The adjustment screw 30 is preferably formed of a polymeric material and is threadedly received in the bore 12 with an interference fit to provide a substantially liquid tight seal between the adjustment screw 30 and the carburetor body 14 to prevent fuel leakage therebetween through the threaded passage. The adjustment screw 30 has a threaded shank 55 and an enlarged head 56 with a slot 58 therein constructed to receive a tool such as a screwdriver to rotate the adjustment screw 30 relative to the carburetor body 14. The enlarged head 56 may directly bottom out on the carburetor body 14 to limit the insertion of the adjustment screw 30 into the carburetor body 14 or a shoulder 60 may be provided elsewhere on the shank 55 of the screw 30 to provide a stop surface engageable with the carburetor body 14.

Figure 4:
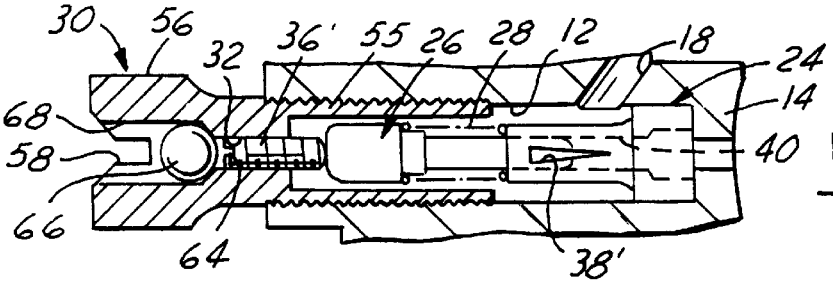
FIG. 4 is a cross-sectional view of a fuel mixture adjusting and limiting device having an adjustment pin press fit into an opening of the adjustment screw.
Figure 5:
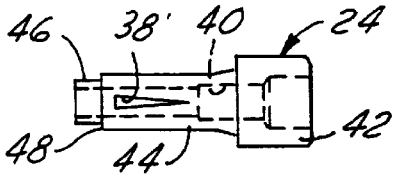
FIG. 5 is a side view of an alternate embodiment of the body of the fuel mixture adjusting and limiting device having a triangular inlet opening.
Figure 6:
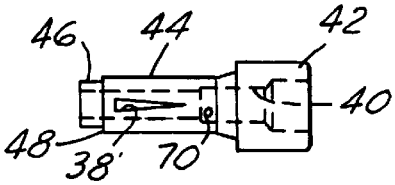
FIG. 6 is a side view of another embodiment of the body of the fuel mixture adjusting and limiting device having a secondary inlet opening.

The adjustment pin 36 is preferably threadedly received in the bore 32 of the adjustment screw 30 and has a free end 62 extending into the counterbore 34 and a slotted head 64 constructed to receive a tool such as a screwdriver to rotate the adjustment pin 36 relative to the adjustment screw 30 and thereby vary the axial location of the free end 62 of the adjustment pin 36 and hence the metering pin 26 relative to the opening 38. After the desired axial location of the adjustment pin 36 is achieved, a plug 66, such as a round ball is preferably press fit into a counterbore 68 in the adjustment screw head 56 preventing access to the adjustment pin 36 to prevent its axial location from being altered. Alternatively, as shown in FIG. 4, an adjustment pin 36' may be slidably received with an interference fit in the bore 32 of the adjustment screw 30 with a similar plug 66 preventing access to the adjustment pin 36 after its axial location has been set. In either embodiment, the adjustment pin 36 or 36' is independent of or a separate piece from the metering pin. This separation of the adjustment pin 36, 36' and the metering pin 26 provides a connection such that cocking, radial or other non-axial movement of the adjustment screw 30 will not significantly, if at all, move the metering pin 26. Thus, cocking or side loading of the adjustment screw 30 does not significantly, if at all, effect the fuel flow rate through the inlet opening 38.

Figure 8:
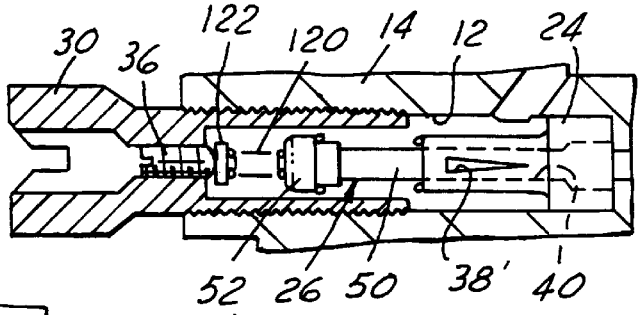
FIG. 8 is a cross-sectional view of a fuel mixture adjusting and limiting device with a thermally responsive spring received between the adjustment pin and the metering pin.

As shown in FIG. 8, a fuel mixture adjusting and limiting device 10 may be provided which is responsive to the operating temperature of the carburetor 14 and the temperature of the fuel in the bore 12. A spring 120 formed of a thermally responsive material is disposed between a plate 122 which bears on the adjustment pin 36 and the head 52 of the metering pin 26 to provide a small force acting on the metering pin 26 which varies as a function of the temperature of the spring 120. As the force provided by the spring 120 on the metering pin 26 changes, the metering pin 26 moves relative to the inlet opening 38' thereby changing the fuel flow rate through the fuel passage 40. Alternatively, the adjustment pin 36 or the metering pin head 52 may be formed of a thermally responsive material, such as nylon, wax, and other polymers, to also provide the desired fuel flow change corresponding to the temperature in the bore 12. Whatever the construction or arrangement, the thermally responsive fuel mixture adjusting and limiting device 10 compensates for changes in the fuel flow rate through the device which occur due to changes in the temperature of fuel in the bore 12 to provide a desired fuel flow rate over a wide range of operating temperatures.

In assembly, the body 24 is press fit into the bore 12 until it bottoms out on the carburetor body 14. The spring 28 is disposed on the shank 50 of the metering pin 26 and the metering pin 26 is inserted into the fuel passage 40 of the body 24 with the spring 28 received over the tip of the body 24 and engaging its shoulder 48. The adjustment screw 30 is then completely threaded into the bore 12 until its shoulder 60 bears on the carburetor body 14. Next, the axial location of the adjustment pin 36 is adjusted to displace the metering pin 26 relative to the body 24 to its desired fully extended position reducing the fuel flow area of the inlet opening 38. In this position, the fuel flow area of the inlet opening 38 is calibrated to provide the minimum required fuel flow for desired operation of the engine. Alternatively, the metering pin 26 may completely close off or restrict the inlet opening 38 and a secondary inlet opening 70 (FIG. 6) may be provided in the body 24 downstream of the metering pin which always remains open and is sized to provide the minimum desired fuel flow rate through the fuel passage 40 independently of the inlet opening 38. Finally, the plug 66 is inserted into the counterbore 68 of the adjustment screw 30 to prevent further adjustment of the adjustment pin 36 which would change the minimum fuel flow rate setting.

To increase the fuel flow rate through the inlet opening 38, the adjustment screw 30 can be rotated in a direction backing the screw 30 out of the bore 12 and thereby axially moving the adjustment pin 36 away from the body 24. As the adjustment screw 30 and adjustment pin 36 are axially moved the spring 28 displaces the metering pin 26 to uncover more of the inlet opening 38 and thereby increase the effective fuel flow area of the inlet opening 38.

Figure 7:
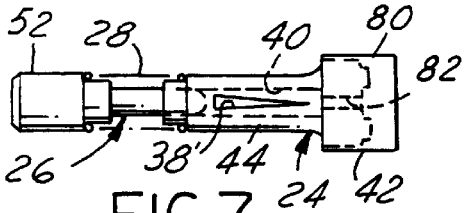
FIG. 7 is a cross-sectional view of the body of the fuel mixture adjusting and limiting device having a metering jet in the fuel passage downstream of the inlet opening.

The maximum fuel flow rate through the fuel passage 40 can be controlled in a number of ways. First, the total size of the inlet opening 38 when completely open can be designed to provide the desired maximum fuel flow rate. Second, the uncompressed or free length of the spring 28 can be designed to limit the movement of the metering pin 26 away from the body 24 such that even when the metering pin 26 is in its fully retracted position it closes a portion of the inlet opening 38 so that the remaining open area provides the maximum fuel flow rate through the fuel passage 40. Thus, as the adjustment screw 30 is backed out of the bore 12 of the carburetor body 14 the spring 28 will bias the metering pin 26 into engagement with the adjustment pin 36 until the spring 28 reaches its maximum or free length whereupon continued rotation of the adjustment screw 30 will disengage the adjustment pin 36 from the metering pin 26. Thus, even if the adjustment screw is completely backed out of the carburetor bore 12 the metering pin 26 will still be disposed in the body 24 restricting a portion of the inlet opening 38. Third, as shown in FIG. 7, a fuel metering jet 80 having a fixed opening 82 can be provided downstream of the inlet opening 38 in the fuel passage 40 of the body 24. The fixed opening 82 of the jet 80 will control the maximum flow rate of fuel therethrough when the flow area of the inlet opening 38 is greater than the flow area of the jet opening 82. Indeed the fixed opening or orifice 82 can be designed to operate under sonic flow conditions. In each of these embodiments, the fuel mixture adjusting and limiting device 10 of this invention prevents the end user from exceeding the maximum fuel flow rate through the device 10 by rotation of the adjustment screw 30 which would result in too rich of a fuel and air mixture being delivered to the engine and increased hydrocarbon emissions from the engine.

Similarly, by initially calibrating the device to provide the minimum fuel flow when the adjustment screw is fully threaded into the bore, the device prevents the end user from causing the device to provide less than the desired minimum fuel flow rate through the device by rotation of the adjustment screw. Providing less than the set minimum fuel flow rate would result in too lean of a fuel and air mixture being delivered to the engine which may result in the engine overheating, seizure of the engine and/or excessive emissions.

Figure 9:
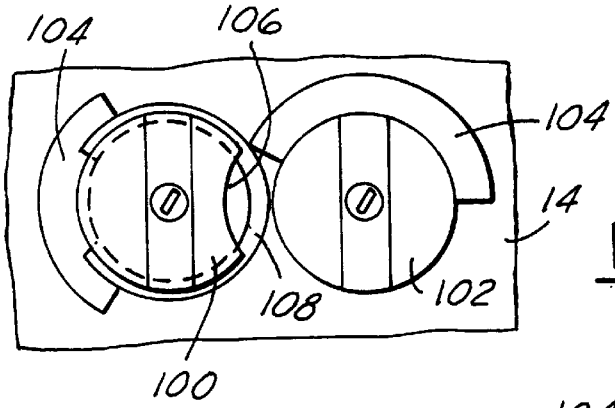
FIG. 9 is a plan view of a pair of adjustment screws for an alternate embodiment of a carburetor having both idle speed and high speed fuel mixture adjusting and limiting devices each with an adjustment screw having a radially extending lobe on its head to limit its rotation.
Figure 10:
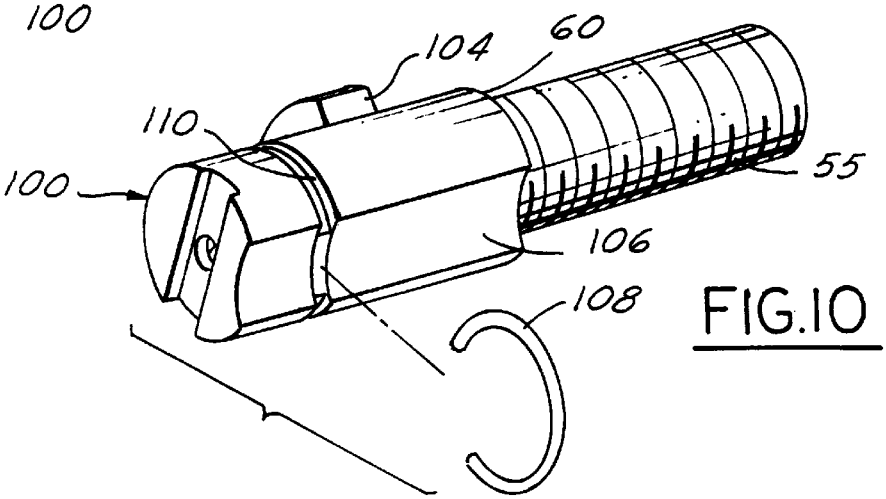
FIG. 10 is a perspective view of an adjustment screw of FIG. 9.

In some carburetors, such as those having an idle speed and a high speed fuel mixture adjusting device, it may be desirable to limit the rotation of the idle and high speed adjustment screws 100, 102 (FIGS. 9 and 10) of each device. As shown in FIGS. 9 and 10, a radially extending lobe 104 may be integrally formed with each adjustment screw 100, 102 thereby obviating the need for a separate limiter cap previously used with needle valve fuel mixture assemblies. To enable the adjustment screws 100, 102 to be initially rotated and threaded into the carburetor body 14, one of the adjustment screws 100 has an arcuate recess 106 formed therein to enable initial rotation of the other adjustment screw 102 during assembly. More specifically, in assembly, screw 100 is threaded into its bore and seated. Then, screw 102 is threaded into its bore and seated and the ring 108 is installed on screw 100. To limit the rotation of the adjustment screws 100, 102 after assembly, a split ring 108 or other stop is inserted into a groove 110 in the adjustment screw 100 having the recess 106 to provide a stop surface engaged by the lobe 104 of the other adjustment screw 102 to limit rotation of the other adjustment screw 102. Also, in lieu of ring 108 a sleeve or band can be telescoped over the head of screw 100 preferably with a press fit to limit the relative rotation of each screw 100, 102. The integral lobe 104 construction reduces the cost to manufacture and assemble the fuel mixture devices and also provides increased tamper proofing of the devices because separate limiter caps, which can potentially be removed by the end user, are not used.

In each embodiment, the fuel mixture adjusting and limiting device 10 enables simple calibration of the device 10 to provide the maximum and minimum fuel flow rates therethrough. Further, the device 10 itself prevents the end user from exceeding the maximum and minimum fuel flow rates by rotating the adjustment screw 30 without the need for additional parts such as limiter caps. Finally, if limitation of the rotation of the adjustment screw 30 is desired, such as in carburetors having both idle and high speed fuel mixture devices 10, integral lobes 104 can be provided on the adjustment screws 100, 102. The devices 10 are easily calibrated and adaptable to many carburetor and engine designs, provide a consistent fuel flow throughout the life of the carburetor and are tamper proof.

I claim:

1. A fuel mixture adjusting and limiting apparatus for a carburetor having a body with a bore and a fuel supply passage communicating with the bore comprising:

a body defining a fuel passage and constructed to be received in the bore of the carburetor;

an inlet opening formed in the body communicating the fuel supply passage of the carburetor with the fuel passage of the body;

a metering pin slidably received relative to the inlet opening in the body for reciprocation between extended and retracted positions and constructed to at least partially restrict the inlet opening when in one of its extended and retracted positions; and an adjustment screw threadedly received in the bore of the carburetor body whereby, rotation of the adjustment screw axially displaces the adjustment screw and the adjustment screw bears on and displaces the metering pin at least during a portion of its range of axial displacement to move the metering pin between its extended and retracted positions to thereby control the extent of restriction of the inlet opening, to vary and control the fuel flow rate through the fuel passage.

2. The apparatus of claim 1 wherein the metering pin is slidably received in the fuel passage of the body.

3. The apparatus of claim 1 wherein the metering pin is slidably received over the body.

4. The apparatus of claim 1 which also comprises an adjustment pin carried by the adjustment screw and moveable relative to the adjustment screw, the adjustment pin is constructed to bear on and displace the metering pin at least during a portion of the range of axial movement of the adjustment screw.

5. The apparatus of claim 4 wherein the adjustment pin is formed of a thermally responsive material to vary the displacement of the metering pin corresponding to the temperature of the adjustment pin.

6. The apparatus of claim 4 which also comprises a hole through the adjustment screw and the adjustment pin is slidably received through the hole so that the axial location of the adjustment pin can be varied relative to the metering pin.

7. The apparatus of claim 4 which also comprises a threaded bore through the adjustment screw and the adjustment pin is threadedly received in the threaded bore such that rotation of the adjustment pin relative to the adjustment screw varies the axial location of the adjustment pin relative to the adjustment screw.

8. The apparatus of claim 7 which also comprises a plug adjacent the adjustment pin which prevents rotation of the adjustment pin, the plug is installed after a desired, fixed axial location of the adjustment pin relative to the metering pin is achieved.

9. The apparatus of claim 8 wherein the plug is a ball press fit into the hole of the adjustment screw.

10. The apparatus of claim 8 wherein the plug is press fit into the hole of the adjustment screw.

11. The apparatus of claim 1 wherein the inlet opening is axially elongate.

12. The apparatus of claim 11 wherein the inlet opening is generally triangular.

13. The apparatus of claim 11 wherein the inlet opening is generally rectangular.

14. The apparatus of claim 1 which also comprises a spring yieldably biasing the metering pin to its retracted position wherein the metering pin provides the least amount of restriction to fuel flow through the inlet opening.

15. The apparatus of claim 14 wherein in its fully retracted position the metering pin partially restricts fuel flow through the inlet opening.

16. The apparatus of claim 15 wherein the axial position of the metering pin when the metering pin is in its fullly retracted position is determined by the uncompressed or free-length of the spring.

17. The apparatus of claim 1 wherein the inlet opening is sized to provide a desired maximum fuel flow rate through the fuel passage when the fuel flow through the inlet opening is unrestricted.

18. The apparatus of claim 1 wherein when the metering pin is in its fully extended position fuel may flow through a portion of the inlet opening.

19. The apparatus of claim 1 which also comprises a second inlet opening in the body sized to permit a minimum desired fuel flow rate through the fuel passage and which is not restricted by the metering pin, and the metering pin can completely close off the fuel flow through the inlet opening when in its fully extended position.

20. The apparatus of claim 1 which also comprises a metering jet disposed in the fuel passage downstream of the inlet opening and having an opening through which the fuel in the fuel passage flows, the opening is constructed to limit the maximum fuel flow rate through the fuel passage.

21. The apparatus of claim 1 wherein the adjustment screw is formed of a polymeric material and is threaded into the bore in the carburetor body with an interference fit between them to prevent fuel in the bore from leaking beyond the adjustment screw.

22. The apparatus of claim 1 wherein the adjustment screw also has a lobe extending radially therefrom, the lobe is constructed to engage at least one stop to limit rotation of the adjustment screw.

23. The apparatus of claim 22 which also comprises a second fuel mixture adjusting and limiting apparatus carried by the carburetor and having an adjustment screw with a radially extending lobe, the lobe of each adjustment screw is constructed to be restrained by the other adjustment screw to limit rotation of its associated adjustment screw.

24. The apparatus of claim 23 wherein the adjustment screw of one fuel mixture adjusting and limiting apparatus has a recessed portion therein permitting the other fuel mixture adjusting and limiting apparatus to be rotatably inserted into the carburetor without its lobe contacting the one adjustment screw, after assembly of each apparatus into the carburetor, a stop is provided adjacent the recess to engage the lobe of the other adjustment screw and limit its rotation.

25. The apparatus of claim 1 wherein the adjustment screw has a radially extending shoulder which bears on the carburetor body to limit rotation of the adjustment screw.

26. The apparatus of claim 1 which also comprises a thermally responsive member disposed adjacent to the metering pin and constructed to vary the displacement of the metering pin in response to variations in the temperature of fuel in the bore to vary the fuel flow rate through the fuel passage.

27. The apparatus of claim 26 wherein the member is a spring which provides a force acting on the metering pin which varies in response to changes in the temperature of the spring.

28. The apparatus of claim 26 wherein the member is operably connected to the metering pin.

* * * * *